United States Patent [19]

Imgrüth et al.

[11] 4,236,239

[45] Nov. 25, 1980

[54] ELECTRONIC TIMEPIECE COMPRISING TWO DIFFERENT DISPLAYS

[75] Inventors: Max Imgrüth, Basel; Claude A. Gygax, Evilard, both of Switzerland

[73] Assignee: Societe Suisse pour l'Industrie Horlogere Management Services S.A., Bienne, Switzerland

[21] Appl. No.: 55,246

[22] Filed: Jul. 6, 1979

[51] Int. Cl.[3] ..... G04B 19/24; G04C 21/34; G04B 37/00

[52] U.S. Cl. ..... 368/72; 368/29; 368/82; 368/88; 368/276; 368/301

[58] Field of Search ..... 58/23 R, 50 R, 50 A, 58/88 R, 89, 127 R, 152 A, 152 C, 38 R, 575, 95 R, 95 B, 152 B; 340/753, 756–765; 73/431

[56] References Cited

U.S. PATENT DOCUMENTS

| | | | |
|---|---|---|---|
| 2,239,894 | 4/1941 | Keen | 340/756 X |
| 3,320,585 | 5/1967 | Hines | 340/756 |
| 3,357,703 | 12/1967 | Hurley | 58/152 R X |
| 3,662,535 | 5/1972 | Hedrick | 58/39.5 |
| 3,875,741 | 4/1975 | Hastings | 58/153 |
| 4,015,418 | 4/1977 | Rochat | 58/89 |

*Primary Examiner*—Edith S. Jackmon

*Attorney, Agent, or Firm*—Griffin, Branigan & Butler

[57] ABSTRACT

The small-sized electronic timepiece comprises a casing susceptible to turn entirely on itself in a support in order to expose in a first position an analog display and in a second position a digital display. The support is constituted by a rectangular plate two opposed edges of which have upwardly extending wing portion, the wristband or any other fastening system being fixed in the neighborhood of said wing portions. The casing is adapted to slide parallel to said wing portions from one edge to the other of the plate and to effect its turning movement in at least a third extreme position, the latter permitting an easier replacement of an energy source.

6 Claims, 5 Drawing Figures

ELECTRONIC TIMEPIECE COMPRISING TWO DIFFERENT DISPLAYS

BACKGROUND OF THE INVENTION

The present invention relates to an electronic timepiece comprising a casing susceptible to turn entirely on itself in a support in order to expose in a first position a first face of said casing and in a second position a second face opposed to the first.

Several similar devices have been previously proposed. In a known arrangement the wristwatch comprises a casing incorporating a mechanical movement with a classical hands display. In order to protect the glass and all the fragile organs of the watch, the display face may be turned on itself to disappear within a retaining means which supports the casing, the metallic back cover thereby being brought to face an observer.

In a further known arrangement, the watch casing may pivot within a ring constituting a support attached to the wristband. In this case the upper part of the casing contains a movement with time display and the lower part either a compass or a thermometer or a barometer.

Finally a wristwatch which presents on the same face both an analog display and a digital display is known. Generally both displays are juxtaposed. As the dial dimensions are limited for a wristwatch, it is necessary to decrease the size of each display thereby reducing legibility of the data.

SUMMARY OF THE INVENTION

The present invention proposes to overcome this problem through utilisation of two displays, analog and digital, of normal size situated respectively on opposed faces of the casing.

A further object of the invention is to allow an easy replacement of the energy source without any uncasing of the movement.

Still a further object of the invention is to enhance the alarm forming normally part of the electronic circuit which controls the digital display even when the analog display faces the observer.

DETAILED DESCRIPTION OF THE INVENTION

Figure 1:
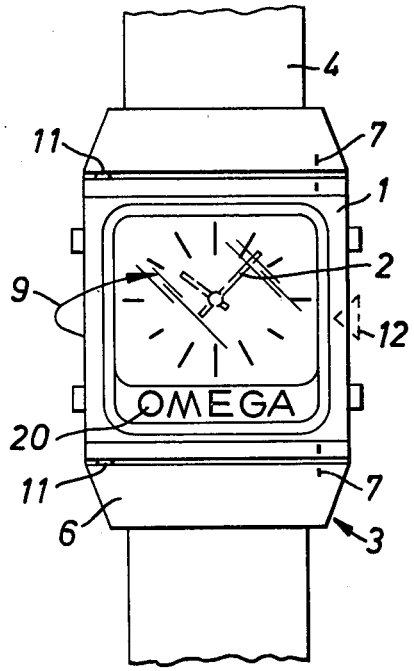
FIG. 1 shows the timepiece when the casing presents its first face displaying the time by analog means.
Figure 3:
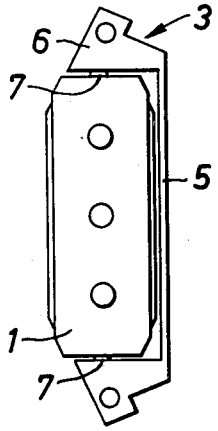
FIG. 3 is a side view of the FIGS. 1 and 2.

FIG. 1 represents a wristwatch comprising a casing 1, an electro-mechanical display 2, a support 3 and a wristband 4. As better shown in FIG. 3, support 3 comprises a rectangular plate 5 two opposed edges of which have upwardly extending wing portions 6 giving the shape of a U having a relatively small depth, the wristband 4 being fixed in the neighbourhood of said wing portions. Two pins 7 secured to the casing may slide within two longitudinal grooves forming part of the wing portions not represented on the figure.

Figure 4:
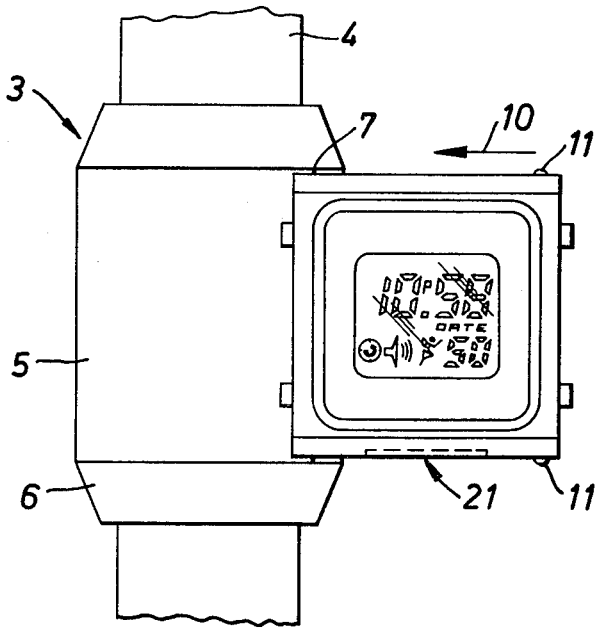
FIG. 4 shows the casing of the timepiece when brought into its extreme position in respect of the support.

If the digital display 8 located on the hidden face of the casing is desired, one pivots said casing through 180° in the sense of the arrow 9. One passes thereby to the extreme position as shown in FIG. 4. It is sufficient now to slide the casing in the sense of the arrow 10 in order to reach the second position shown in FIG. 2 where appears the digital display. The same operations but in the other sense are repeated if it is wished to return to the first position as illustrated by FIG. 1. In order to maintain the casing in place with respect to the support there is provided a click mechanism the spring mounting balls 11 of which cooperate with the grooves.

Figure 2:
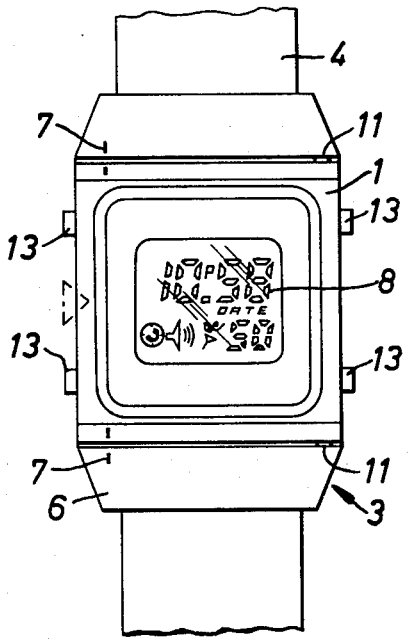
FIG. 2 shows the timepiece when the casing presents its second face displaying the time by digital means.

The casing 1 is provided with a corrector 12 for the analog functions and with corrector 13 for the digital functions as seen on FIGS. 1 and 2.

Figure 5:
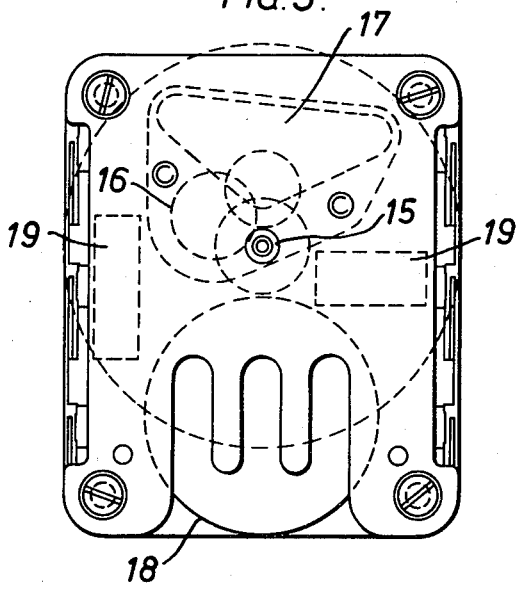
FIG. 5 shows the arrangement of the several components in regard to one another within the watchcasing.

FIG. 5 shows how the several components are arranged within the watchcase when the analog display faces the observer. One indentifies thereon the handaxis 15, the gear train 16 and the micromotor 17. At the same level and next to the electro-mechanical movement are located the energy source or cell 18 and the several electronic circuits 19 which control both the electro-mechanical display and the digital display. Under this plurality of elements which occupies the most important part of the casing thickness is situated the digital display. The described arrangement allows a double display system superposed back to back, the thickness of which is not substantially greater than a single display. This arrangement also enables an easy access to the cell without uncasing the movement. This access is possible through an opening 21, formed in the casing and which is accessible when the casing is located in the extreme position as shown in FIG. 4.

The electronic circuit may contain an alarm. In this case the sound transducer is constituted by a glass on which a ceramic piezoelectric membrane is glued. In a preferred version, this membrane is located beneath the glass which covers the analog display and proximate an edge of this glass, beneath a decorative mark 20 as it will be seen in FIG. 1.

It will be appreciated that the proposed double display enables use to such electronic alarm even if the analog display is visible since to perform this function, the electronic circuits forming part of the digital display are employed. Generally this function is not possible in a watch equipped with a single analog display.

The above described version of the invention concerns a wristwatch. Nevertheless the invention is not limited to this kind of timepiece and could be applied, for example, to a pendant-watch.

What is claimed is:

1. An electronic timepiece comprising a support, a casing susceptible to turn entirely on itself in said support in order to expose in a first position a first face of said casing and in a second position a second face opposed to the first, said support comprising a rectangular plate with two opposed edges having upwardly extending wing portions giving the shape of a U having a relatively small height, an attachment means fixed to said plate in the neighbourhood of said wing portions, said casing being adapted to slide parallel to said wing portions from one edge to the other of said plate, and further to effect its turning movement in at least a third extreme position, the casing containing an energy source, electronic circuits and first and second separate displays, the first display occupying said first face of the casing and arranged to display the time by analog means and the second display occupying said second face and arranged to display the time by digital means.

2. An electronic timepiece as set forth in claim 1 including analog display driving means, the energy source, electronic circuits and the analog display driving means being placed side by side.

3. An electronic timepiece as set forth in claim 1, wherein a lateral opening is made into the casing through which the energy source may be replaced when said casing is brought into said third extreme position.

4. An electronic timepiece as set forth in claim 1 wherein the electronic circuits comprise an alarm system adapted to be used in either said first or said second position.

5. An electronic timepiece as set forth in claim 1, 2 or 3 wherein the electronic timepiece is a wristwatch.

6. An electronic timepiece as claimed in claim 1, 2 or 3 wherein the electronic timepiece is a pendant-watch.

* * * * *